US006638473B2

(12) United States Patent
Nishioka

(10) Patent No.: US 6,638,473 B2
(45) Date of Patent: Oct. 28, 2003

(54) COOLING DEVICE FOR BLAST FURNACE BOTTOM WALL BRICKS

(75) Inventor: Kiyoshi Nishioka, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 13 days.

(21) Appl. No.: 10/018,252

(22) PCT Filed: Apr. 13, 2001

(86) PCT No.: PCT/JP01/03201

§ 371 (c)(1),
(2), (4) Date: Dec. 13, 2001

(87) PCT Pub. No.: WO01/79564

PCT Pub. Date: Oct. 25, 2001

(65) Prior Publication Data

US 2002/0158378 A1 Oct. 31, 2002

(30) Foreign Application Priority Data

Apr. 14, 2000 (JP) ..... 2000-114094

(51) Int. Cl.[7] ..... C21B 7/10
(52) U.S. Cl. ..... 266/280; 266/46; 266/190
(58) Field of Search ..... 266/46, 193, 194, 266/280, 190

(56) References Cited

U.S. PATENT DOCUMENTS 6,416,708 B1 * 7/2002 Van Laar ..... 266/194

FOREIGN PATENT DOCUMENTS

| | | | |
|---|---|---|---|
| GB | 2023265 | * 12/1979 | ..... 266/194 |
| JP | 7-133989 | 5/1995 | |
| JP | 10-103327 | 4/1998 | |
| JP | 10-281663 | 10/1998 | |
| JP | 11-13719 | 1/1999 | |

* cited by examiner

*Primary Examiner*—Melvyn Andrews
(74) *Attorney, Agent, or Firm*—Kenyon & Kenyon

(57) ABSTRACT

The present invention is: a cooling apparatus, capable of extending the service life of a blast furnace by suppressing the molten-iron-induced erosion of a carbon brick in the sidewall of a blast furnace bottom by preventing the cooling ability for the carbon brick from deteriorating, structured to bond a metal cooler to the carbon brick with an adhesive containing carbon powder, a synthetic resin and a hardening agent, and form a bonding layer containing 50 mass % or more, preferably 50 to 85 mass %, of solid carbon between the cooler and the carbon brick; and a cooling apparatus according to the above further structured to embed anchor bolts at an end in the carbon brick, have the other end of the anchor bolts pierce the cooler, and fasten the cooler to the carbon brick with the anchor bolts by tightening lock nuts with washers having a spring function provided between the nuts and the cooler. The equipment costs and installation costs of the cooling apparatuses are lower than those of conventional stave coolers, and they can be installed at any position according to the condition of the bricks.

3 Claims, 2 Drawing Sheets

COOLING DEVICE FOR BLAST FURNACE BOTTOM WALL BRICKS

TECHNICAL FIELD

This invention relates to a cooling apparatus for cooling a carbon brick in the sidewall of a blast furnace bottom.

BACKGROUND ART

The service life of a blast furnace bottom determines that of an entire blast furnace, and the prevention of wear of carbon bricks forming the sidewall of a blast furnace bottom is the most important task for extending the service life of the blast furnace. Erosion by molten iron, embrittlement resulting from thermal stress, etc. are responsible for the wear of the carbon bricks in the sidewall of the furnace bottom, and intensive cooling is considered to be the most effective measure to prevent the carbon bricks from wearing.

Carbon bricks, which are highly resistant against molten iron and excellent in heat conductivity, are used as refractory bricks for the sidewall of a conventional blast furnace bottom for preventing the erosion by the molten iron. The carbon bricks are cooled by water spray on the outer steel shell of the furnace bottom or stave coolers embedded in the furnace bottom sidewall. Whereas the carbon bricks are cooled indirectly from outside by the water spray method on the shell, they are cooled more directly, and from a closer position, by the stave cooler method.

FIG. 4 shows a conventional brick cooling structure using stave coolers 11. The stave coolers 11 are embedded between the carbon bricks 1 and the steel shell 13, and ramming material 12 fills the space between the stave coolers 11 and the bricks 1 to absorb positioning error in the installation of the stave coolers 11 and the shifting of the carbon bricks 1 owing to their thermal expansion.

The ramming material 12 consists of a highly heat conductive and elastic material and, when the carbon brick 1 thermally expands after the blow-in of the blast furnace, expansion is absorbed by the compression of the ramming material 12 and gaps are prevented from forming around the stave coolers 11, and their cooling ability is thus maintained.

However, the ramming material 12 deteriorates and the carbon bricks 1 expand and contract over the operation period of a blast furnace, and gaps may form between the carbon bricks 1 and the stave coolers 11, causing the deterioration of the cooling ability. When, for instance, some deposit forms on the inner surfaces of the carbon bricks 1, the cooling from the side of the stave coolers 11 becomes too large at the portion and the brick temperature falls. The carbon bricks 1 contract as a result but, since the ramming material 12 does not expand, gaps form locally between the carbon bricks 1 and the stave coolers 11, causing the cooling ability to fall.

As a countermeasure against the above fall of the cooling ability, Japanese Unexamined Patent Publication No. H10-280017 proposes a method, of repairing the sidewall of a blast furnace bottom, wherein the heat conduction of the ramming material 12 is measured, a steel shell 13 is cut out at the portion where the heat conduction is low on an occasion of temporary shutdown of the furnace, the ramming material 12 is removed from the portion and replaced with a new ramming material 12, and the blowing is resumed after restoring the steel shell 13.

By conventional cooling methods using the stave coolers 11, the carbon bricks 1 are eroded at the parts contacting the molten iron, leading to the loss of the bricks when gaps form between the carbon bricks 1 and the stave coolers 11 owing to the expansion and contraction of the carbon bricks 1 and the deterioration of the ramming material 12 and, as explained above, the cooling ability is lowered as a result. To forestall the problem, the blast furnace is blown-off before the bricks are lost and repair work is done to replace the bricks.

The repair work as proposed in said patent publication is done for the purpose of extending the service life of a blast furnace as much as possible. However, said repair work is only a temporary measure taken after the fall of the cooling ability has actually taken place, and the erosion of the carbon bricks by the molten iron continues as a result of the reduced cooling ability.

Further, Japanese Unexamined Patent Publication No. H7-133989 proposes a method wherein, during carbon brick laying work of a blast furnace, several carbon bricks are bonded together with a carbon adhesive to form a large block. An adhesive consisting of carbon powder, a liquid synthetic resin and a hardening agent is disclosed as the adhesive used therein.

DISCLOSURE OF THE INVENTION

The object of the present invention is to suppress the erosion of carbon bricks by molten iron by preventing the ability to cool the carbon bricks from falling at the sidewall of a blast furnace bottom, and thereby to extend the service life of the blast furnace.

The present invention relates to a cooling apparatus for a brick in a sidewall of a blast furnace bottom, which comprises a carbon brick forming a sidewall of a blast furnace bottom, a metal cooler cooling the carbon brick, and a bonding layer bonding the carbon brick and the metal cooler, wherein the bonding layer contains 50 mass % or more, preferably 50 to 85 mass %, of solid carbon as a result of an adhesive, containing carbon powder, a synthetic resin and a hardening agent, forming the bonding layer.

In the cooling apparatus for a brick in a sidewall of a blast furnace bottom according to the present invention, it is preferable that the apparatus further comprises: anchor bolts each of which having one end embedded in an outer surface of the carbon brick and the other end piercing the bonding layer and the cooler and extending beyond the outer surface of the cooler, lock nuts fastening the cooler and the brick at the other end of the anchor bolts, and washers having a spring function provided between the lock nuts and the cooler.

BEST MODE FOR CARRYING OUT THE INVENTION

Figure 1:
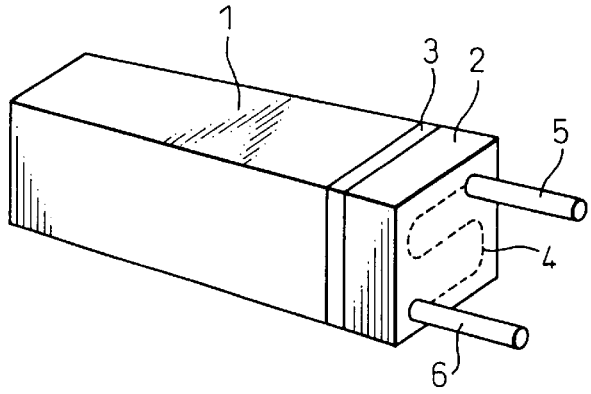
FIG. 1 is a perspective view showing an example of the assembly of the cooling apparatus according to the present invention for the sidewall brick of a blast furnace bottom.
Figure 4:
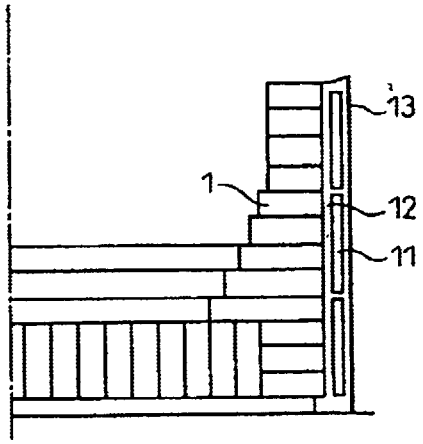
Fig.4 Prior Art
FIG. 4 is a sectional view showing an example of the arrangement of conventional cooling apparatuses for the sidewall bricks of a blast furnace bottom.

The cooling apparatus according to the present invention is a cooling apparatus for cooling the carbon brick 1 laid in the sidewall of a blast furnace bottom as shown in FIG. 4, wherein, as shown in the example of FIG. 1, a cooler 2, which is made of metal, is bonded to a carbon brick 1 with an adhesive containing carbon powder, a synthetic resin and a hardening agent, and a bonding layer 3 containing 50 mass % or more of solid carbon is formed between the cooler 2 and the carbon brick 1.

Note that the solid carbon contained in the bonding layer according to the present invention includes carbon powder and the carbon formed through the decomposition and carbonization of carbon compounds in the synthetic resin and the hardening agent.

The cooler 2 is made of metal such as copper, steel or cast iron and a cooling water pipe 4 is embedded in it. It is cooled with water entering from a cooling water inlet pipe 6 and discharged from a cooling water outlet pipe 5.

A room-temperature-setting carbon adhesive containing carbon powder, a synthetic resin and a hardening agent as disclosed in said Japanese Unexamined Patent Publication No. H7-133989 or similar is applicable to the present invention, but it is necessary that a bonding layer 3 containing 50 mass % or more of solid carbon is formed between the carbon brick 1 and the cooler 2.

The reason why 50 mass % or more of solid carbon has to be contained in the bonding layer is that low heat conductivity of the synthetic resin and the hardening agent of the adhesive has to be improved by the solid carbon such as the carbon powder and the carbon formed through the decomposition and carbonization of the synthetic resin and the hardening agent.

Figure 5:
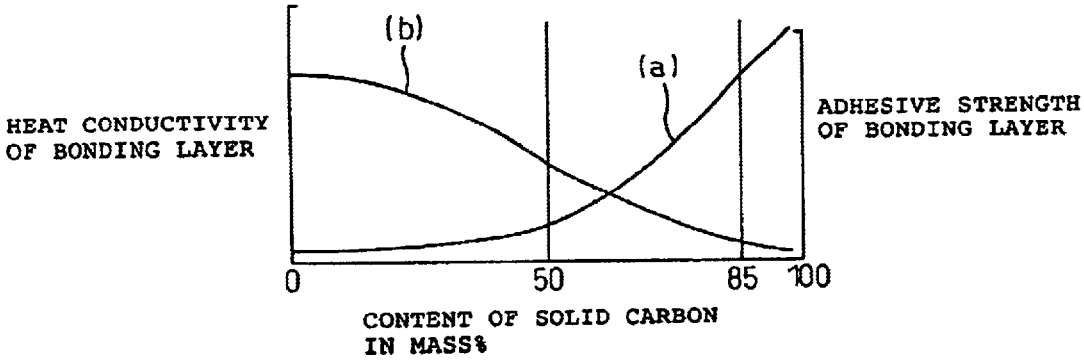
FIG. 5 is a graph showing the relations of the content of solid carbon in the bonding layer to its heat conductivity and adhesive strength in the cooling apparatus according to the present invention.

FIG. 5 shows the relations of the solid carbon content in the bonding layer to its heat conductivity (a) and adhesive strength (b). The heat conductivity is low when the amount of the solid carbon is below 50 mass % and, therefore, 50 mass % or more of solid carbon has to be contained in it. This is because, when the amount of the solid carbon is 50 mass % or more, grains of the solid carbon contact each other to raise the heat conductivity. When the amount of the solid carbon exceeds 85 mass %, on the other hand, the adhesive strength of the bonding layer is lowered and, for this reason, it is preferable that the content of the solid carbon is 85 mass % or less.

Fine powder of roasted anthracite, calcined coke, artificial graphite, natural graphite, carbon black and the like can be used as the carbon powder to be mixed in the adhesive.

AS for the synthetic resin, thermosetting resins having a high carbonization ratio such as phenolic resin, furan resin, furfural resin and varieties of their transformation products are suitable. Besides the above, polyisocyanate, polyimide, epoxy resin, etc. can be used as well. They can be used individually or as a mixture of two or more.

Paratoluenesulfonic acid, phosphoric acid, hexamethylenetetramine, etc. can be used as the hardening agent and it is mixed into the adhesive immediately before use.

Besides the above, a diluent such as ethylene glycol, furfuryl alcohol and the like may be added for controlling the viscosity of the adhesive.

The adhesive in gel containing the above substances is applied thickly to the bonding surface of the cooler 2, then the cooler is attached to the carbon brick 1, and the bonding layer 3 is formed after hardening the adhesive through drying. It is essential that the bonding layer 3 contains 50 mass % or more of the solid carbon so that high heat conductivity is secured by the solid carbon.

Note that it is preferable to bond the cooler to the carbon brick with the adhesive between.

Since the bonding layer 3 is used in contact with the cooler 2, most of the contents of the adhesive such as the synthetic resin, hardening agent and so forth remain in it during use. For this reason, the adhesive strength is maintained over a long period, with little separation even locally, withstanding the thermal expansion and contraction of the carbon brick 1.

Accordingly, when cooling water is fed through the cooling water pipe 4 of the cooler 2, the heat of the carbon brick 1 is carried away by the water through the highly heat-conductive bonding layer 3, and the cooling ability little deteriorates over a long blast furnace operation period.

Figure 2:
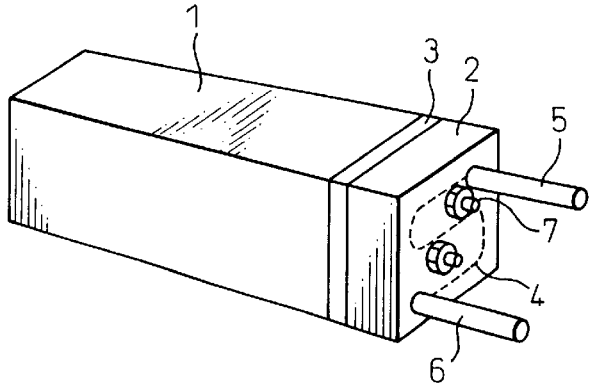
FIG. 2 is a perspective view showing an alternative example of the assembly of the cooling apparatus according to the present invention for the sidewall brick of a blast furnace bottom.

Further, in the cooling apparatus according to the present invention, it is preferable that the cooler 2 is fastened to the carbon brick 1 with anchor bolts 7, as shown in FIG. 2, in addition to the formation of the bonding layer 3. The structure here is that, as seen in the example shown in FIG. 3, the cooler 2 and the brick 1 are fastened by: anchor bolts 7 each of which having one end (anchor side) embedded in an outer surface of the carbon brick 1 and the other end piercing the bonding layer 3 and the cooler 2 and extending beyond the outer surface of the cooler 2, lock nuts 9 fastening the cooler 2 and the brick 1 at the other end of the anchor bolts, and washers 8 having a spring function provided between the lock nuts 9 and the cooler 2.

Figure 3:
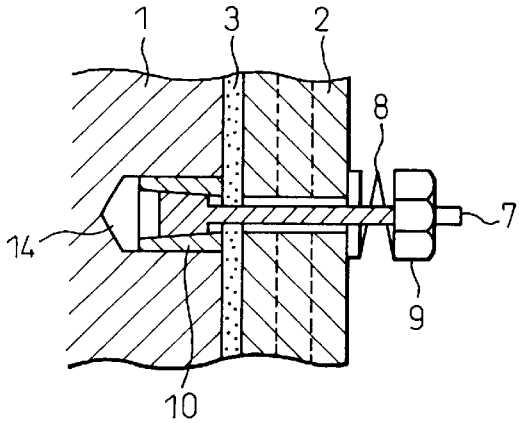
FIG. 3 is a sectional view showing the alternative example of the assembly of the cooling apparatus according to the present invention for the sidewall brick of a blast furnace bottom.

This structure is explained in more detail referring to FIG. 3. An anchor bolt 7 is inserted at one end (anchor side end) into a cylindrical anchor 10 having an outer surface with small projections for preventing slip, a tapered inner surface and longitudinal slits allowing it to expand circumferentially, and the anchor 10 is fitted and embedded in an anchoring hole 14 drilled in an outer surface of a carbon brick 1.

A steel coil spring, a spring-shaped washer, or similar, may be used as the washer 8 having a spring function. A nut incorporating a spring or a washer may be used.

For the installation of the cooling apparatus, the holes 14 for the anchors 10 are drilled beforehand in the carbon brick 1 and the anchors 10 with the anchor bolts 7 set in them are fitted into the holes; then, after applying the adhesive thickly to the bonding surface of the cooler 2, the cooler 2 is attached to the carbon brick 1 as explained above, with the anchor bolts 7 going through holes drilled through the cooler 2; when the bonding layer 3 is formed after hardening the adhesive through drying, the cooler 2 is fastened to the carbon brick 1 by tightening the nuts 9 with the washers 8 under them. The tightening of the nuts 9 has to be done under a suitable initial stress in consideration of the compression of the spring of the washers 8.

In this preferred embodiment, the adhesion between the cooler 2 and the carbon brick 1 is maintained firmer and over a longer period thanks to the spring force of the washers 8 having the spring function. This makes it easy to increase the carbon powder content in the adhesive, and, thus, to increase the amount of the solid carbon in the bonding layer beyond 85%, which enhances the heat conductivity of the bonding layer 3 yet more. Further, even if the synthetic resin and the hardening agent in the bonding layer 3 are deteriorated or evaporated over the long use of the cooling apparatus, the adhesion between the cooler 2 and the carbon brick 1 is maintained by the spring force. If carbon compounds contained in the synthetic resin and the hardening agent of the bonding layer 3 decomposition and carbonize, the percentage of the solid carbon is increased and the heat conductivity of the bonding layer 3 is enhanced.

In the installation of the cooling apparatus according to the present invention, the cooling apparatus formed by bonding the cooler 2 to the carbon brick 1 for the sidewall of a blast furnace bottom with the adhesive can be disposed in the furnace height direction in up to several layers, preferably five layers, from the furnace bottom. The cooler 2 can also be bonded to a large block formed by bonding several carbon bricks, as a common cooler for the bonded bricks.

INDUSTRIAL APPLICABILITY

When the cooling apparatus according to the present invention is installed in the sidewall of a blast furnace bottom, the carbon brick is water-cooled through the metal cooler and the highly heat-conductive bonding layer. The adhesion of the cooler to the carbon brick by means of the bonding layer hardly deteriorates during the operation of the blast furnace over a long period and nor does its cooling ability. The erosion of the carbon bricks by the molten iron is thus suppressed and the service life of the blast furnace is extended.

In addition, the cooling apparatus according to the present invention is cheaper than conventional stave coolers and, therefore, the equipment costs and installation costs are minimized. Since the cooling apparatus can be installed at any position of the sidewall of a blast furnace bottom, the cooling ability of the carbon bricks can be increased in accordance with the condition of their damage. The cooling apparatus according to the present invention can be installed, as a retrofit, to a blast furnace using the conventional water spray method, on the shell surface, to cool its bottom.

I claim:

1. A cooling apparatus for cooling a brick in the sidewall of a blast furnace bottom providing a metal cooler which is attached to one surface of the brick, comprising: a carbon brick forming a sidewall of a blast furnace bottom, a metal cooler cooling the carbon brick, and a bonding layer bonding the carbon brick and the metal cooler, wherein the bonding layer contains 50 mass % or more of solid carbon as a result of an adhesive, containing carbon powder, a synthetic resin and a hardening agent, forming the bonding layer.

2. A cooling apparatus for a brick in a sidewall of a blast furnace bottom according to claim 1, wherein the bonding layer contains 50 to 85 mass % of solid carbon.

3. A cooling apparatus for a brick in a sidewall of a blast furnace bottom according to claim 1, the apparatus further comprising: anchor bolts each of which having one end embedded in an outer surface of the carbon brick and the other piercing the bonding layer and the cooler and extending beyond the outer surface of the cooler, lock nuts fastening the cooler and the brick at the other end of the anchor bolts, and washers having a spring function provided between the lock nuts and the cooler.

* * * * *